US011566836B2

(12) United States Patent
Wu et al.

(10) Patent No.: US 11,566,836 B2
(45) Date of Patent: Jan. 31, 2023

(54) DEVICE FOR ISOLATING VIBRATIONS

(71) Applicant: National University of Defense Technology, Changsha (CN)

(72) Inventors: Wei Wu, Changsha (CN); Qingqing Qin, Changsha (CN); Baoquan Ou, Changsha (CN); Ting Chen, Changsha (CN); Yi Xie, Changsha (CN); Pingxing Chen, Changsha (CN)

(73) Assignee: NATIONAL UNIVERSITY OF DEFENSE TECHNOLOGY, Changsha (CN)

( * ) Notice: Subject to any disclaimer, the term of this patent is extended or adjusted under 35 U.S.C. 154(b) by 337 days.

(21) Appl. No.: 16/914,566

(22) Filed: Jun. 29, 2020

(65) Prior Publication Data

US 2020/0408457 A1 Dec. 31, 2020

(51) Int. Cl.

| | |
|---|---|
| ***F25B 9/10*** | (2006.01) |
| ***F25D 19/00*** | (2006.01) |
| ***F25B 9/14*** | (2006.01) |

(52) U.S. Cl.

CPC ..... *F25D 19/006* (2013.01); *F25B 9/10* (2013.01); *F25B 9/14* (2013.01); *F17C 2203/0636* (2013.01)

(58) Field of Classification Search

CPC .. F25D 19/006; F25B 9/10; F25B 9/14; F17C 2203/0636

See application file for complete search history.

(56) References Cited

U.S. PATENT DOCUMENTS

| | | | | |
|---|---|---|---|---|
| 2015/0252799 | A1* | 9/2015 | Roscher | F16F 15/04 62/6 |
| 2017/0261413 | A1* | 9/2017 | Schreibeis | F16F 15/06 |
| 2019/0220770 | A1* | 7/2019 | Amini | F04B 15/08 |
| 2019/0348251 | A1* | 11/2019 | Monroe | G01L 21/30 |

* cited by examiner

*Primary Examiner* — Nael N Babaa

(74) *Attorney, Agent, or Firm* — Matthias Scholl P.C.; Matthias Scholl

(57) ABSTRACT

A device for isolating vibrations includes an ion trap, a cryocooler, a primary chamber, a secondary chamber, a vacuum ion pump, a heat exchanger, a sample chamber, a support part, a connector, a heat conduction part, a first platform, a second platform, and a flexible connecting part. The primary chamber, the secondary chamber, and the vacuum ion pump are fixedly disposed on the first platform. The connector is a hollow structure disposed between the primary chamber and the secondary chamber. The primary chamber communicates with the secondary chamber via the hollow structure thereby forming an airtight chamber. The vacuum ion pump is connected to the primary chamber via a five-way flange. The support part is fixed on the second platform. The cryocooler is fixed on the support part. The cryocooler includes a cold head and a machine head. The cold head is suspended in the primary chamber.

15 Claims, 3 Drawing Sheets

DEVICE FOR ISOLATING VIBRATIONS

CROSS-REFERENCE TO RELATED APPLICATIONS

Pursuant to 35 U.S.C. § 119 and the Paris Convention Treaty, this application claims foreign priority to Chinese Patent Application No. 201910570256.9 filed Jun. 27, 2019, the contents of which, including any intervening amendments thereto, are incorporated herein by reference.

BACKGROUND

The disclosure relates to a device for isolating vibrations.

An ion trap is a physical device in combination of electric or magnetic fields to capture charged particles, known as ions, in a system isolated from an external environment. Ion traps have a number of scientific uses in mass spectrometry, basic physics research, and controlling quantum states. Low temperature ion traps are more conducive to the operation of the quantum bits than normal temperature ion traps.

Known methods to keep the ultra-low temperature of the ion traps involve either the use of liquid helium, or the use of a cycle refrigerator.

SUMMARY

The disclosure provides a device for isolating vibrations.

The device for isolating vibrations comprises an ion trap, a cryocooler, a primary chamber, a secondary chamber, a vacuum ion pump, a heat exchanger, a sample chamber, a support part, a connector, a heat conduction part, a first platform, a second platform, and a flexible connecting part.

The primary chamber, the secondary chamber, and the vacuum ion pump are fixedly disposed on the first platform; the connector is a hollow structure and disposed between the primary chamber and the secondary chamber, and the primary chamber communicates with the secondary chamber via the hollow structure thereby forming an airtight chamber; the vacuum ion pump is connected to the primary chamber via a five-way flange; the support part is fixed on the second platform; the cryocooler is fixed on the support part; the cryocooler comprises a cold head and a machine head; the cold head is suspended in the primary chamber; and the heat exchanger is disposed on one end of the cold head; the sample chamber is disposed in the secondary chamber; the ion trap is disposed in the sample chamber; the heat exchanger is connected to the sample chamber via the heat conduction part; and the flexible connecting part is disposed between the connector and the secondary chamber, and between the heat conduction part and the sample chamber.

The cryocooler is a G-M cycle refrigerator comprising a primary cold head and a secondary cold head; the heat exchanger is disposed on one end of the secondary cold head; and the heat exchanger is a cold finger.

The device further comprises a thermostatic chamber disposed in the airtight chamber; the secondary cold head, the cold finger, the heat conduction part, the flexible connecting part, and the sample chamber are disposed in the thermostatic chamber; a size of the thermostatic chamber is second to that of the airtight chamber; and the thermostatic chamber comprises an opening communicating with the primary cold head.

The thermostatic chamber comprises a first heat shield disposed in the primary chamber, a second heat shield disposed in the connector, and a third heat shield disposed in the secondary chamber; the first heat shield comprises a first end connected to the primary cold head and a second end connected to the second heat shield; and the second heat shield is connected to the third heat shield via a copper braid.

The heat exchange medium between the secondary cold heat and the cold finger, and between the primary cold heat and the first heat shield, is liquid helium.

The flexible connecting part between the connector and the secondary chamber is a metal bellows, and the flexible connecting part between the heat conduction part and the sample chamber is a copper braid.

A rubber bellows is disposed between the machine head and the primary chamber.

The support part comprises a support column and a base fixedly disposed on the support column; the support column is vertically disposed on the second platform; and the machine head is fixed on the base.

The first platform is an optical table, and the second platform is the ground.

The heat conduction part comprises oxygen-free copper.

Figure 1:
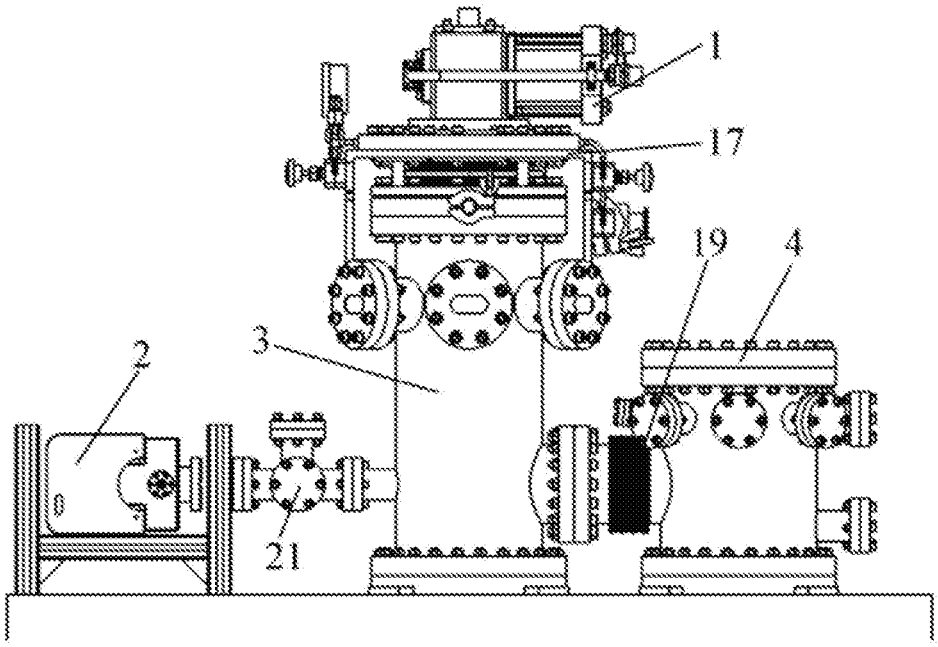
FIG. 1 is a schematic diagram of a device for isolating vibrations according to one embodiment of the disclosure.

In the drawings, the following reference numbers are used: 1. G-M cycle refrigerator; 2. Vacuum ion pump; 3. Primary chamber; 4. Secondary chamber; 5. Ion trap; 6. Primary cold head; 7. Secondary cold head; 8. Cold head; 9. Sample chamber; 10. Third heat shield; 12. Cold finger; 13. First heat shield; 14. Second heat shield; 15. Heat conduction part; 16. Copper braid; 17. Base; 18. Support column; 19. Metal bellows; 20. Rubber bellows; 21. Five-way flange; 23. Optical table.

DETAILED DESCRIPTION

To further illustrate the disclosure, embodiments detailing a device for isolating vibrations are described below. It should be noted that the following embodiments are intended to describe and not to limit the disclosure.

As shown in FIGS. 1-5, the disclosure provides an ultra-low temperature device for isolating vibrations for quantum simulation and ion trap experiment, the device comprising an ion trap 5, a G-M cycle refrigerator 1, a primary chamber 3, a secondary chamber 4, a vacuum ion pump 2, a cold finger 12, a sample chamber 9, a support part, a connector, a heat conduction part 15, an optical table 23, and a flexible connecting part.

The primary chamber 3, the secondary chamber 4, and the vacuum ion pump 2 are fixedly disposed on the optical table 23. The connector is a hollow structure and disposed between the primary chamber 3 and the secondary chamber 4, and the primary chamber 3 communicates with the secondary chamber 4 via the hollow structure thereby forming an airtight chamber; the vacuum ion pump 2 is connected to the primary chamber 3 via a five-way flange 21, thereby realizing the vacuum environment of the airtight chamber.

The separation of the primary chamber 3 and the secondary chamber 4 is conductive to the operation of the ion trap in the secondary chamber. That is, for convenient quantum measurement by photon or other signals, the primary chamber 3 and the secondary chamber 4 are separately disposed. The heat conduction part 15 is between the primary chamber 3 and the secondary chamber 4, which can conduct heat to the sample chamber 9.

The support part is fixed on the ground 24. The G-M cycle refrigerator 1 fixedly disposed on the support part. The G-M cycle refrigerator 1 comprises a cold head 8 and a machine head; the cold head 8 is suspended in the primary chamber 3; and the cold finger 12 is disposed on one end of the cold head.

The sample chamber 9 is disposed in the secondary chamber 4; the ion trap 5 is disposed in the sample chamber 9; the cold finger 12 is connected to the sample chamber 9 via the heat conduction part.

The flexible connecting part is disposed between the connector and the secondary chamber 4, and between the heat conduction part 15 and the sample chamber 9, for vibration isolation.

The flexible connecting part between the heat conduction part 15 and the sample chamber 9 is a copper braid 16, through which the secondary cold head 7 exchanges the heat energy with the ion trap 5 in the sample chamber 9.

Figure 2:
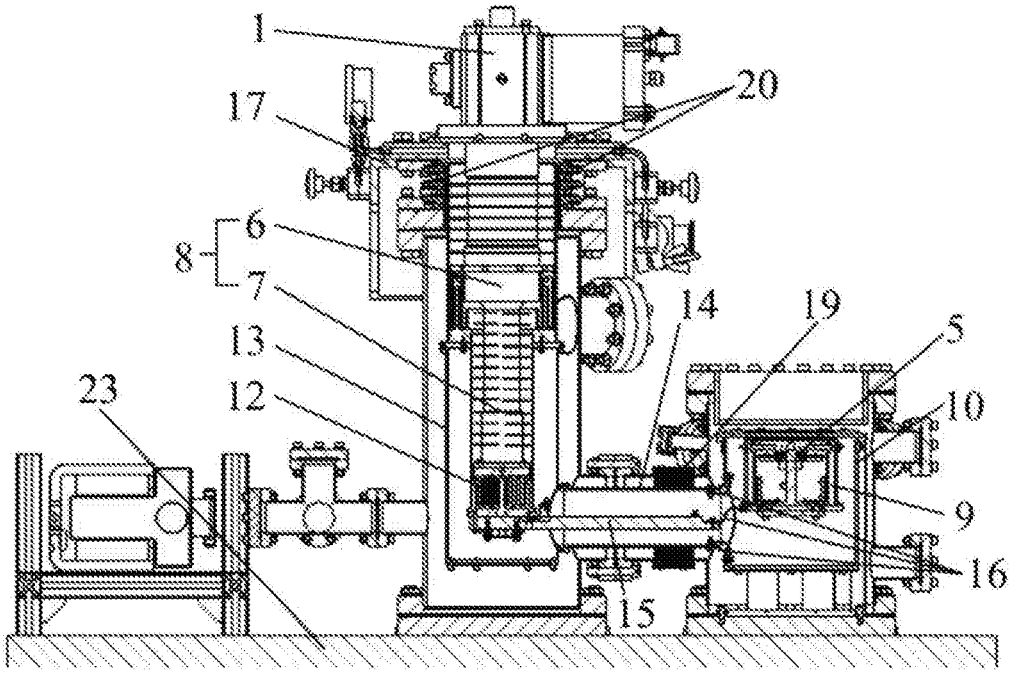
FIG. 2 is a sectional view of a device for isolating vibrations according to one embodiment of the disclosure.

As shown in FIG. 2, the thermostatic chamber comprises a first heat shield 13 disposed in the primary chamber, a second heat shield 14 disposed in the connector, and a third heat shield 10 disposed in the secondary chamber; the first heat shield 13 comprises a first end connected to the primary cold head 6 and a second end connected to the second heat shield 14; and the second heat shield is connected to the third heat shield via the copper braid 16. Thus, the 4 Kelvin constant temperature environment of the ion trap 5 is maintained through the heat exchange by the copper braid. The primary chamber 3 is connected to the secondary chamber 4 via the connector. A metal bellows 19 is disposed between the connector and the secondary chamber 4, thus buffering the influence of the vibration of the primary chamber 3 on the secondary chamber 4. That is to say, all the connections with the secondary chamber where the ion trap 5 is located are a flexible connection, thus minimizing the impact of the vibration of the G-M cycle refrigerator 1 on the ion trap 5 in the sample chamber 9. In certain embodiments of the disclosure, the metal copper selected as the flexible connection material for heat exchange can maintain the 4 Kelvin low temperature environment of the ion trap 5.

Figure 3:
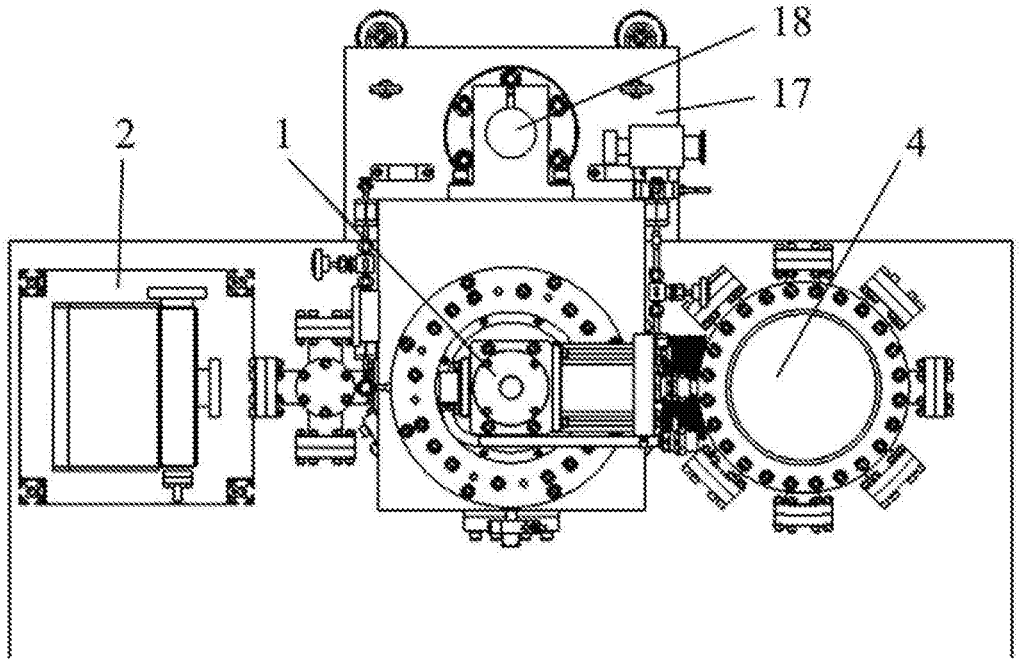
FIG. 3 is a top view of a device for isolating vibrations according to one embodiment of the disclosure.
Figure 4:
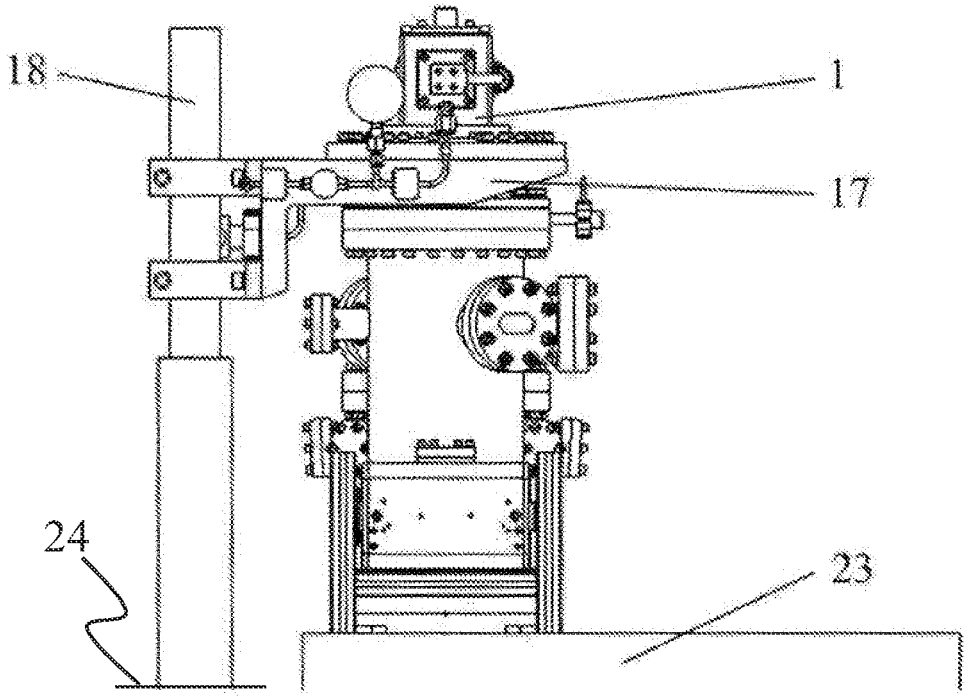
FIG. 4 is a side view of a device for isolating vibrations according to one embodiment of the disclosure.

As shown in FIG. 3 and FIG. 4, the support part of the device for isolating vibrations comprises a support column 18 and a base 17 fixedly disposed on the support column 18. The support column 18 is fixed on the ground 24. The G-M cycle refrigerator 1 is fixed on the base 17. The other parts such as the copper braid 16, metal bellows 19, rubber bellows 20 of the device for isolating vibrations are fixed on the optical table 23. Thus, by fixing the G-M cycle refrigerator 1 independently on the base, the vibration imposing on the parts of the device, particularly on the ion trap 5, is greatly reduced.

Figure 5:
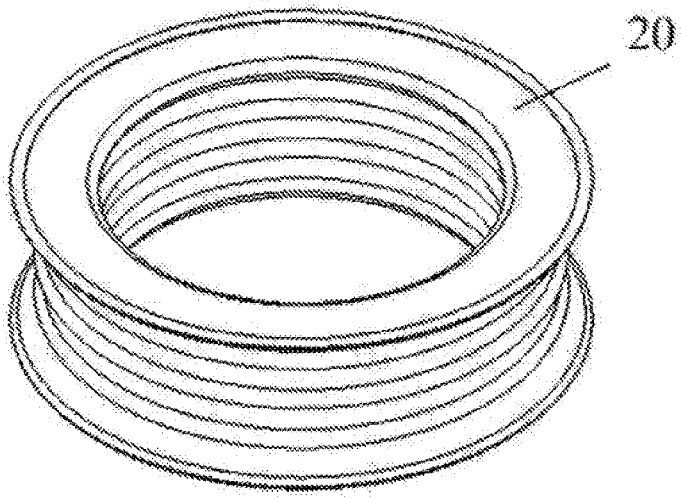
FIG. 5 is a schematic diagram of a rubber bellows of a device for isolating vibrations according to one embodiment of the disclosure.

As shown in FIG. 5, the G-M cycle refrigerator is tightly coupled to the primary chamber 3 via a rubber bellows 20. Because the cold head 8 is sealed in the primary chamber 3, the arrangement of the rubber bellows 20 between the G-M cycle refrigerator 1 and the primary chamber 3 can reduce the vibration of the cold head 8, improving the sealing properties of the device.

The device for isolating vibrations of the disclosure employs the G-M cycle refrigerator 1 to provide the cooling capacity, the cooling power of 1.5 W@4.2 Kelvin can be satisfied. The G-M cycle refrigerator 1 is independently disposed on the base, and the parts of the device are connected through flexible connecting parts, so that the vibration of the ion trap is reduced to within ±100 nm. Under the condition of 4.2 Kelvin extremely low temperature, the heating rate of ion in the environment space is reduced, and the quantum bit coherence time is increased. From an economic point of view, under the condition of controllable cost, the vibration caused by the G-M refrigerator 1 is greatly reduced, while the heat conduction is effectively maintained, and the ion trap 5 is maintained at a low temperature of 4 Kelvin.

The secondary chamber where the sample is located is separated from the primary chamber where the cold source is located, thus simplifying the installation and use of the device, avoiding the operator from being frostbitten by the low temperature during the installation or use, so the device is safe.

It will be obvious to those skilled in the art that changes and modifications may be made, and therefore, the aim in the appended claims is to cover all such changes and modifications.

What is claimed is:

1. A device, comprising:

an ion trap;

a cryocooler;

a primary chamber;

a secondary chamber;

a vacuum ion pump;

a heat exchanger;

a sample chamber;

a support part;

a connector;

a heat conduction part;

first connecting part; and a second connecting part;

wherein the primary chamber, the secondary chamber, and the vacuum ion pump are configured to be fixedly disposed on a first platform;

the connector is a hollow structure and disposed between the primary chamber and the secondary chamber, and the primary chamber communicates with the secondary chamber via the hollow structure thereby forming an airtight chamber; the vacuum ion pump is connected to the primary chamber via a five-way flange;

the support part providing a support for the cryocooler is configured to be fixed on a second platform; the cryocooler comprises a cold head and a machine head connected to the cold head; the machine head is disposed on the support part and the cold head is suspended in the primary chamber; and the heat exchanger is disposed in the primary chamber and on one end of the cold head;

the sample chamber is disposed in the secondary chamber; the ion trap is disposed in the sample chamber; the heat conduction part is disposed between the heat exchanger and the sample chamber, for conducting heat from the sample chamber to the heat exchanger to cool the sample chamber; and the first connecting part is disposed between the connector and the secondary chamber, and the second connecting part is disposed between the heat conduction part and the sample chamber; the first connecting part and the second connecting part are configured to reduce impact of vibration of the primary chamber on the secondary chamber.

2. The device of claim 1, wherein the cryocooler is a G-M cycle refrigerator, the cold head of the G-M cycle refrigerator comprising a primary cold head and a secondary cold head; the heat exchanger is disposed on one end of the secondary cold head; and the heat exchanger is a cold finger.

3. The device of claim 2, wherein the device further comprises a thermostatic chamber disposed in the airtight chamber; the secondary cold head, the cold finger, the heat conduction part, the second connecting part, and the sample chamber are disposed in the thermostatic chamber; and the thermostatic chamber comprises an opening communicating with the primary cold head.

4. The device of claim 3, wherein the thermostatic chamber comprises a first heat shield disposed in the primary chamber, a second heat shield disposed in the connector, and a third heat shield disposed in the secondary chamber; the first heat shield comprises a first end connected to the primary cold head and a second end connected to the second heat shield; and the second heat shield is connected to the third heat shield via a copper braid.

5. The device of claim 4, wherein a heat exchange medium between the secondary cold head and the cold finger, and between the primary cold head and the first heat shield, is liquid helium.

6. The device of claim 1, wherein the first connecting part is a metal bellows, and the second connecting part is a copper braid.

7. The device of claim 5, wherein the first connecting part is a metal bellows, and the second connecting part is a copper braid.

8. The device of claim 1, wherein a rubber bellows is disposed between the machine head and the primary chamber.

9. The device of claim 5, wherein a rubber bellows is disposed between the machine head and the primary chamber.

10. The device of claim 1, wherein the support part comprises a support column and a base fixedly disposed on the support column; the support column is vertically disposed on the second platform; and the machine head is fixed on the base.

11. The device of claim 5, wherein the support part comprises a support column and a base fixedly disposed on the support column; the support column is vertically disposed on the second platform; and the machine head is fixed on the base.

12. The device of claim 1, wherein the first platform is an optical table, and the second platform is the ground.

13. The device of claim 5, wherein the first platform is an optical table, and the second platform is the ground.

14. The device of claim 1, wherein the heat conduction part comprises oxygen-free copper.

15. The device of claim 5, wherein the heat conduction part comprises oxygen-free copper.

* * * * *